US007361826B2

(12) United States Patent
Brun

(10) Patent No.: US 7,361,826 B2
(45) Date of Patent: Apr. 22, 2008

(54) PORTABLE ELECTRONIC MUSICAL KEYBOARD INSTRUMENT

(76) Inventor: Mario Brun, 92, Desrochers, Sorel, Quebec (CA) J3P 6N9

( * ) Notice: Subject to any disclaimer, the term of this patent is extended or adjusted under 35 U.S.C. 154(b) by 3 days.

(21) Appl. No.: 11/397,700

(22) Filed: Apr. 5, 2006

(65) Prior Publication Data

US 2007/0245885 A1 Oct. 25, 2007

(51) Int. Cl.
*G10C 3/12* (2006.01)
*G10H 1/34* (2006.01)

(52) U.S. Cl. ..... 84/719; 84/429; 984/257

(58) Field of Classification Search ..... 84/423 R, 84/429, 468, 719, 744; 984/257
See application file for complete search history.

(56) References Cited

U.S. PATENT DOCUMENTS 176,365 A * 4/1876 Simpson ..... 84/429
1,810,519 A * 6/1931 Gerhart ..... 84/327
3,272,056 A * 9/1966 Dean ..... 84/403
3,335,629 A * 8/1967 Brodin ..... 84/1
3,541,912 A * 11/1970 Radke ..... 84/715
3,610,802 A * 10/1971 Berwin ..... 84/671
3,955,461 A * 5/1976 Ivie ..... 84/327
4,126,070 A * 11/1978 Hill ..... 84/718
D254,496 S * 3/1980 Hill ..... D17/1
4,226,161 A * 10/1980 Goetsch ..... 84/376 A
4,304,167 A * 12/1981 Tait ..... 84/429
4,352,310 A * 10/1982 Orlandoni ..... 84/718
4,450,993 A * 5/1984 Ephraim ..... 224/265
4,715,293 A * 12/1987 Cobbs ..... 108/43
4,884,488 A * 12/1989 Curletto ..... 84/376 R
D312,091 S 11/1990 Amiya
D312,264 S * 11/1990 Amiya ..... D17/1
5,029,260 A * 7/1991 Rollason ..... 235/145 R
5,065,661 A * 11/1991 Hacker ..... 84/719
D325,924 S * 5/1992 Yu ..... D17/5
5,463,925 A * 11/1995 Galocy ..... 84/423 R
5,667,114 A * 9/1997 Bourque ..... 224/270
D388,246 S * 12/1997 Patterson ..... D3/204
5,841,052 A * 11/1998 Stanton ..... 84/600
6,111,179 A * 8/2000 Miller ..... 84/442
6,237,846 B1 * 5/2001 Lowell et al. ..... 235/145 R
6,384,810 B1 * 5/2002 Selker ..... 345/168
D460,101 S 7/2002 Juhe
D483,793 S * 12/2003 Kitazawa ..... D17/1
6,740,800 B1 5/2004 Cunningham
6,802,662 B1 * 10/2004 Cheng et al. ..... 400/489
7,154,033 B2 * 12/2006 Mutou ..... 84/423 R
2003/0121398 A1 * 7/2003 Mutou ..... 84/423 R
2006/0123982 A1 * 6/2006 Christensen ..... 84/723

FOREIGN PATENT DOCUMENTS

JP 2004348440 A * 12/2004

* cited by examiner

*Primary Examiner*—Lincoln Donovan
*Assistant Examiner*—Andrew Millikin
(74) *Attorney, Agent, or Firm*—Equinox Protection; Franz Bonsang, Patent Agent

(57) ABSTRACT

A portable electronic musical device has a keyboard disposed in a housing connected to a strap and a support plate connected thereto for suspension of housing by strap on shoulders of a person while housing is simultaneously supported on waist of person to allow person to easily move from one geographical position to another while playing instrument. Housing is pivotally connected to support plate by at least one member defining an axis around which housing is rotatable to playing of instrument and to facilitate viewing of hands of person and keys of keyboard while user is playing instrument. To further facilitate playing of instrument and visibility of hands and keys housing is curved with keyboard generally aligned therewith.

21 Claims, 5 Drawing Sheets

PORTABLE ELECTRONIC MUSICAL KEYBOARD INSTRUMENT

FIELD OF THE INVENTION

The present invention relates to musical devices, and in particular to a portable electronic musical keyboard instrument.

BACKGROUND OF THE INVENTION

Electronic musical keyboard instruments are well known in the art. For example, U.S. Design Pat. No. D312,091, issued to Amiya on Nov. 13, 1990 discloses a portable electronic musical keyboard instrument in which a housing having an electronic musical keyboard disposed thereon has a strap connected thereto. The housing may be carried by the strap upon the shoulders and neck of a user by suspending the housing with the strap extending around the shoulders and neck of the person. Accordingly, the instrument may be used, notably by playing music on the keyboard, by a person while carrying the device on the shoulders and neck with the strap, thus allowing the person to geographically displace herself or himself while using the instrument. Unfortunately, the entire mass of the housing is supported by the shoulders and neck when the device is so carried with strap, which may result in strain and discomfort. This strain and discomfort may be aggravated by a downwardly directed force that the person exerts on the keys of keyboard while using the instrument. Further, the generally planarly flat configuration of the keyboard on housing may cause strain on the elbows and shoulders of a person while playing the keyboard as the user must constantly maintain the elbows raised and bent. In addition, as movement of the housing when carried on shoulders and neck will often require displacement of at least a portion of the strap along the shoulders and neck, there is a risk that such movement of the housing will cause friction and discomfort thereto.

U.S. Design Pat. No. D460,101, issued to Juhé on Jul. 9, 2002, discloses an electronic musical keyboard instrument having a keyboard, the ends of which are curved slightly towards one another to facilitate playing of keys in proximity to the ends. However, the instrument, as disclosed, does not appear to provide any means for rendering the instrument easily portable. Further, the keyboard is disposed in an essentially planarly flat configuration, and thus may also cause strain on the elbows and shoulders of a person while playing the keyboard, as the user must constantly maintain the elbows raised and bent.

Accordingly, there is a need for an improved electronic musical keyboard instrument that obviates the aforementioned difficulties.

SUMMARY OF THE INVENTION

It is therefore a general object of the present invention to provide an improved portable electronic musical keyboard instrument.

An advantage of the present invention is that the portable electronic musical keyboard instrument can easily be played by a person during geographical motion of the person from one geographical position.

Another advantage of the present invention is that the portable electronic musical keyboard instrument can be easily moved by a person while the person is playing the instrument and during geographical motion of the person from one geographical position to another.

Yet another advantage of the present invention is that the portable electronic musical keyboard instrument allows for increased body movement and facilitated corporal expression by a person playing the instrument.

A further advantage of the present invention is that the portable electronic musical keyboard instrument allows for reduced bending of elbows and increased extension of arms by a person while playing the instrument, thus reducing stress on the elbows and shoulders.

Still another advantage of the present invention is that the portable electronic keyboard instrument is designed to be easily played by a person with one or both hands.

Still another advantage of the present invention is that the controls for portable electronic keyboard instrument may be manipulated by a person playing the instrument without requiring significantly interrupting engagement of hands on keys of the instrument.

Still another advantage of the present invention is that the keys of the portable electronic musical keyboard instrument are more readily visible to spectators while a person plays the instrument.

Still a further advantage of the present invention is that the portable electronic keyboard instrument may be simultaneously be played and carried by a person in an ergonomic manner with respect to the body of the person playing the instrument.

Yet another advantage of the present invention is that the portable electronic keyboard instrument may be played and carried by a person with less encumbrance of the person by the instrument.

In a first aspect of the present invention, there is provided a portable electronic musical keyboard instrument comprising:

a housing having an electronic musical keyboard housed therein and extending along a top portion thereof and situated generally opposite a bottom portion thereto the electronic musical keyboard having a plurality of keys extending adjacent one another between longitudinally opposed first and second housing ends of the housing, the keys having respective generally opposed first key ends and second key ends situated respectively proximal first and second sides of the housing extending between the first and second housing ends and defining the top portion therewith, the first side being situated proximal a person when playing the instrument, the top portion and the electronic musical keyboard being curved generally vertically away from the first and second housing ends towards a first apex situated at a central position of the housing situated generally centrally between the first and second housing ends;

a support plate;

at least one member connecting the support plate to the housing; and a strap connected to the member and to the housing, the strap and the support plate being respectively adapted for suspending the housing from at least one shoulder of the person and abuttingly contacting a waist of the user for supporting the housing on the waist.

In a second aspect of the invention, there is provided a support for a musical instrument comprising:

a support plate upon which the musical instrument is supported; and at least one elongate member pivotally connecting the support plate to the musical instrument and defining a first axis around which the instrument may be rotated while being supported by the support plate.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
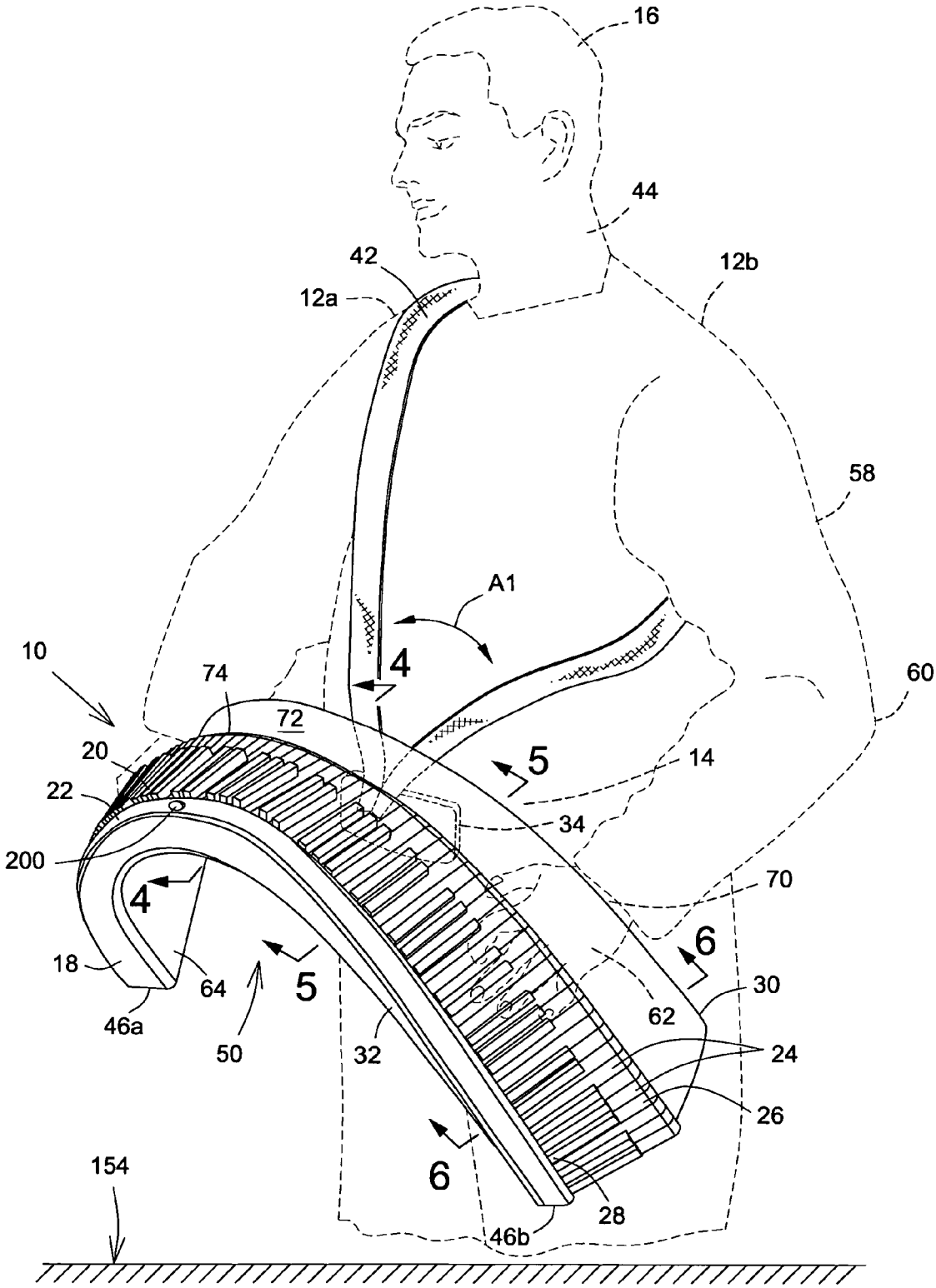
FIG. 1 is a perspective view of an embodiment of a portable electronic musical keyboard instrument, in accordance with an embodiment of the invention, carried on the shoulders and waste of a person playing the instrument.

Referring now to FIG. 1, therein is shown a portable musical electronic keyboard instrument, shown generally as 10, in accordance with an embodiment of the present invention carried on the shoulders 12 and waist 14 of a person 16 playing instrument 10, As shown, instrument 10 has a housing 18 in which an electronic musical keyboard 20 is housed and which extends along a top portion 22 thereof. Musical keyboard 20 has a plurality of keys 24 and which extend adjacent one another and between generally longitudinally generally opposed first and second housing ends, respectively 46*a* and 46*b*, of housing 18. Each key 24 has a respective first key end 26 and a respective second key end 28 which are situated respectively proximal a first side 30 and a second side 32, generally opposed to first side 30, of housing 18. In general, each key 24 is pivotally connected to housing 18 in proximity to respective second key end 28 thereof. As shown in FIG. 1, first side 30 is situated generally proximal to person 16 playing instrument 10 and to support plate 34 when housing 18 is supported thereby on waist of person 16. Second side 32, conversely, is situated generally distal person 16 playing instrument 10 and to support plate 34 when housing 18 is supported thereby on waist of person 16. In general, person 16 plays instrument 10 by, among other things, depressing one or more keys 24 on a respective playing surface 36 thereof, which extends between respective key ends 26, 28.

Figure 2:
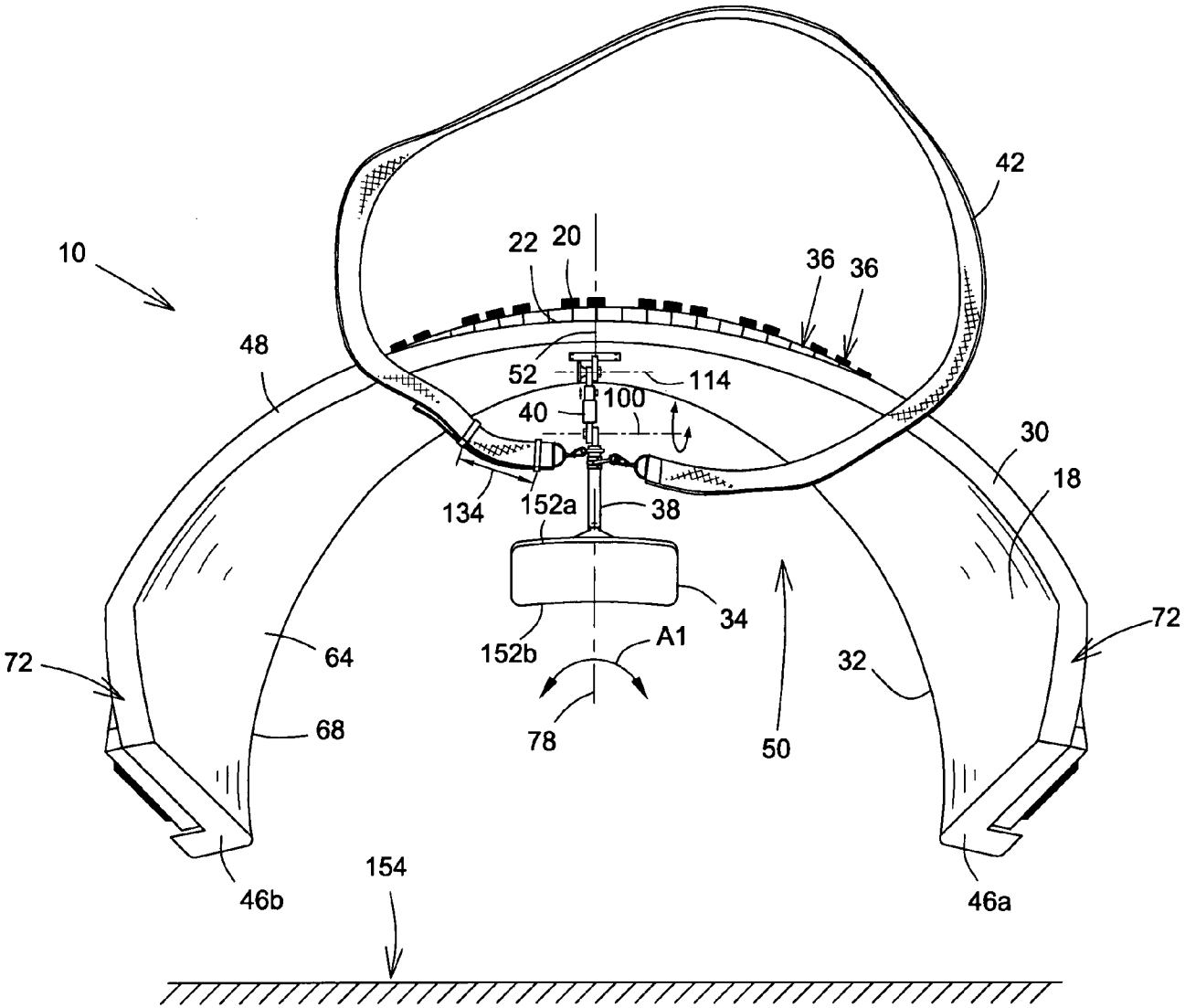
FIG. 2 is a perspective view of a bottom portion of a housing of the portable electronic musical keyboard instrument shown in FIG. 1.

Referring now to FIGS. 1 and 2, support plate 34 is connected to housing 18 by first elongate connecting member 38, directly connected to support plate 34, and optional second elongate connecting member 40 which is preferably, but not necessarily, telescopic. Further, instrument 10 also has a strap 42 connected to first member 38. Strap 42 is adapted for suspending housing 18 from at least one shoulder 12 of person 16. More specifically, and as shown in FIG. 1, strap 42 is extendable over first shoulder 12*a* of person 16 and under opposing second shoulder 12*b* thereof to suspend housing 18 generally in front of person 16 on waist 14. However, strap may also be suspended over both shoulders 12 and around the back of neck 44. Support plate 34 is shaped and sized to rest abuttingly on waist 14 of person 16 and is thus adapted for supporting housing 18 on waist 14 while housing 18 is suspended by strap 42 from shoulder 12 and/or neck 44. As part of mass of housing 18 is supported by support plate 34, mass thereof supported in suspension from shoulder 12, and possibly neck 44, with strap 42 is reduced, thus advantageously reducing strain thereon. At the same time support plate 34, in conjunction with members 38, 40 maintains housing 18 spaced apart from person 16 at a desirable distance for facilitating play thereby.

As shown, support plate 34 is, preferably, generally rectangular in shape. However, support plate 34 may be of any shape or size, provided support plate 34 can abuttingly extend over a portion of waist 14 for supporting housing 18 thereupon. Support plate 34 may be made of any material, including a flexible material, capable of supporting mass of housing 18, such as metals, plastics, or the like. Similarly, housing 18 may be constructed of any material capable of supporting mass of keyboard 20 therein, such as wood, metal, plastic, or the like. Members 38, 40 may also be made of plastic, metal, or any other material capable of supporting mass of housing 18. Strap 42 may be made of any fabric capable of supporting mass of housing 18 and support plate 34. However, since instrument is intended to be easily carriable by person 16 with strap 42 and support plate 34, lightweight materials are preferred for elements 18, 20, 24, 34, 38, 40, 42 thereof. It should also be noted that second member 40 is optional and that housing 18 may be directly fixedly, adjustably, or pivotally connected to support plate 34 by first member 38. Further, second member 40 may be fixedly, adjustably, or pivotally connected to housing 18 by additional members, not shown, connected therebetween. For example, a third member, not shown, could be connected to housing 18 and to second member 40 to connect housing 18 to second member 40.

Reference is again made to FIGS. 1 and 2. Top portion 22, when housing is positioned in a rest position, shown generally as 50, generally faces upward and extends upwardly from each housing end 46*a*, 46*b* to a central position, shown as and defined by central axis 52, situated generally centrally therebetween. More specifically, top portion 22 of housing 18 is preferably curved between housing ends 46 upwardly towards a first apex, generally situated at central position 52, thus defining a first, generally convex curve 48 extending between ends 46 having first apex at central position 52 and along which keyboard extends 20. Keyboard 20 is preferably positioned centrally between housing ends 46, thus aligning keyboard 20 along top portion with a center key, not shown, of keyboard 20 being situated proximal central position 52. As top portion 22 of housing 18, and thereby keyboard 20, is curved with first apex situated generally centrally between housing ends 46, when housing 18 is in rest position 50, keyboard 20 extends curvingly downwardly from central position 52 towards housing ends 48. Thus, when playing instrument 10 with keyboard in rest position 50, including when housing 18 is carried on waist 14 and shoulders 12 with support plate 34 and strap 42, person 16 may increasingly extend arms 58 and unbend elbows 60 as person 16 moves hands 62 away from central position 52 towards housing ends 46, thus reducing strain on elbows 60 and shoulders 12. Further, due to curving of top portion 22, keys 24 proximal housing ends 46, and hands 82 of person 16 while depressing keys 24 proximal housing ends 46, are much more visible to spectators than keys and hands on conventional keyboards, the latter typically extending in front of a person playing them at an angle of 90 degrees relative thereto and from one keyboard end to the other at an angle of approximately 180 degrees. Thus, instrument 10 provides increased visibility of keys 24 and hands 62 of person 16 playing instrument.

Referring still to FIGS. 1 and 2, bottom portion 64 of housing 18 is situated generally opposite top portion 22 and faces, when housing 18 is in rest position 50, generally downward towards a ground surface 154 extending beneath instrument 10. Bottom portion 64 is also, preferably, curved between housing ends 46 towards a second apex, preferably situated at central position 52 on bottom portion 64, to form a second, generally concave curve 68 extending between housing ends 46. As shown, bottom portion 64 preferably extends between housing ends 46 substantially parallel to top portion 22. Thus, first and second apexes are, preferably, aligned and extend through central position 52. Curving of second portion 64 in parallel to first portion 22 advantageously facilitates balancing and maintaining of housing 18 in rest position 50 when carried on person 16 with strap 42 and support plate 34, especially when support plate 34 is connected to housing 18 in proximity to central position 52, as shown in FIG. 2. Further, curving of second portion 64 reduces the distance between bottom portion 64 and top portion 22. Thus, the minimum distance between top portion 22 and support plate 34, when support plate 34 is attached, as shown, to bottom portion 64 by members 38, 40 is reduced, thereby allowing for a greater degree of adjustment of top portion position of top portion 22 relative support plate 34, including distance and angles therebetween, by adjusting length of members 38, 40 and connections therebetween.

Generally speaking, housing 18 flares outwardly, and generally symmetrically, from central position 52 towards each housing end 46, such that the distance between first side 30 and second side 32 is greater at each housing end 46 than at central position 52. Further, housing 18, and notably top portion 22 thereof, may optionally be tapered, as shown in FIG. 2, towards central position 52 in proximity to housing ends 46. Housing ends 46*a*, 46*b* may additionally, optionally taper inwardly toward each other, i.e. towards central position 52, from second side 32 to first side 30, such that length of first side 30 is less than length of second side 32.

It should be noted that, while top portion 22 and bottom portion 64 are preferably curved, top portion 22 and bottom portion 64 may each extend longitudinally along a straight line straight between housing ends 46, at an angle of 90 degrees therewith. However, ergonomic advantages with regard to extension of arms 58 may be compromised. Further, while preferred, bottom portion 64 need not necessarily extend parallel to top portion 22, although balance of housing 18 may be compromised. Additionally, while keyboard 20 is preferably centrally positioned between housing ends 46, keyboard may also extend in greater proximity to one housing end 46 than the other.

Figure 3:
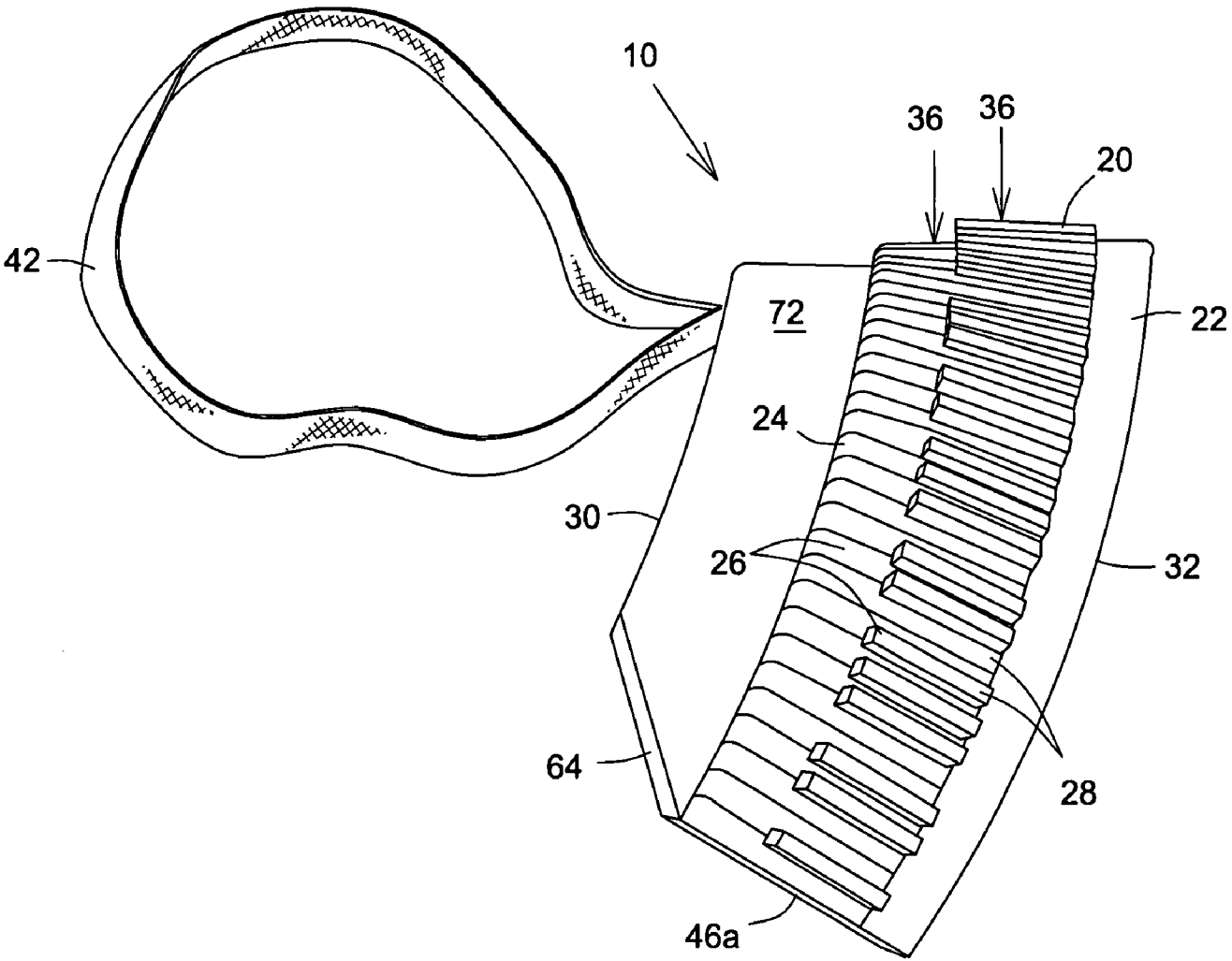
FIG. 3 is a partial perspective view of a top portion of the portable electronic musical keyboard instrument shown in FIG. 1.
Figure 4:
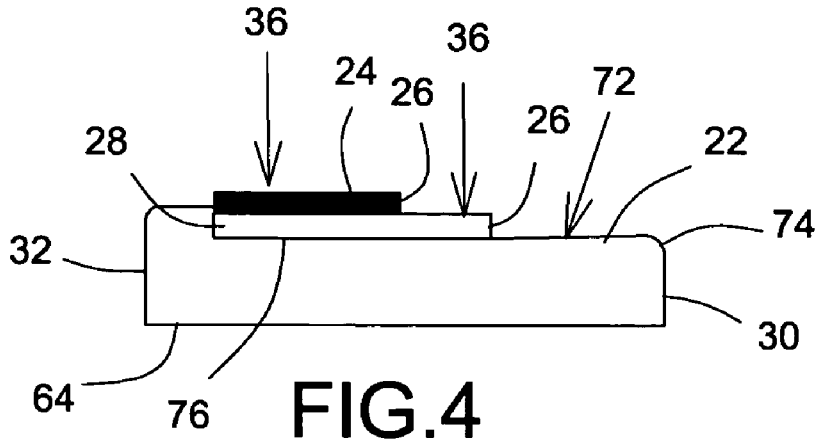
FIG. 4 is a side view of a central portion of the top portion of a housing of the portable electronic musical keyboard instrument shown in FIG. 1, taken along line 4 thereof and illustrating a key situated in the central portion.

Reference is now made to FIGS. 1, 2, 3, and 7. As best shown in FIGS. 1 and 3, top portion 22 also, optionally, has optional hand plate 72 sized and shaped for allowing person 16 to place hands 62 and/or wrists 70 thereon for exerting a force on housing 18 to cause housing 18 to pivot on axis 72 defined by first member 38. Further, optional hand plate 72 may also permit person 16 to rest hands 62 or wrists 70 thereon while playing instrument 10, including depressing keys 24 thereof, to further reduce strain on elbows 60 and shoulders 12, as well as wrists 70. As best shown in FIGS. 1 and 2, hand plate 72 extends from keyboard 20, proximal first key ends 26 of keys 24, to first side 30 of housing 18, along the length of top portion from housing end 46*a* to housing end 46*b*. As best shown in FIGS. 3 and 4, playing surfaces 36 of keys 24 are raised slightly above hand plate 72.

Figure 5:
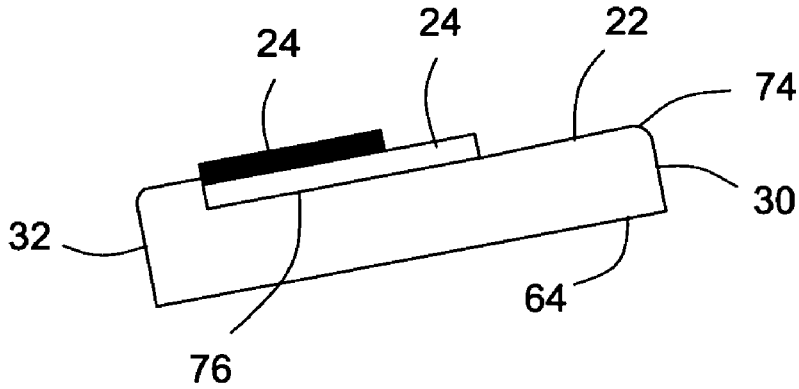
FIG. 5 is a side view of the top portion of a housing of the portable electronic musical keyboard instrument shown in FIG. 1, taken along line 5-5 and illustrating a key situated thereat.
Figure 6:
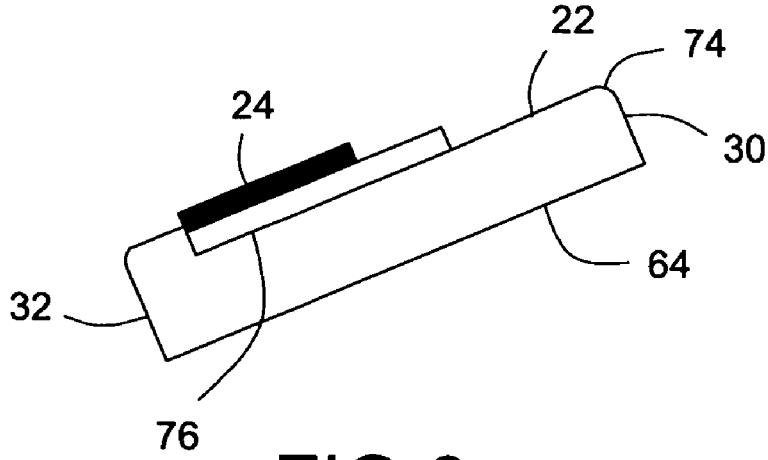
FIG. 6 is a side view of the top portion of a housing of the portable electronic musical keyboard instrument shown in FIG. 1, taken along line 6-6 and illustrating a key situated thereat.

Reference is now made to FIG. 1 in conjunction with FIGS. 4, 5, and 6. In order to further increase visibility of keys 24 and hands 62 to spectators, housing 18 may, optionally, be slanted such that when housing 18 is in rest position 50 top portion slants downwardly from first side 30 towards second side 32. Further, and as shown in FIGS. 4, 5, and 6, slope of top portion 22 when slanted downwardly from first side 30 to second side 32 may, optionally, decrease gradually relative intersecting edge 74, defined by intersection of top portion 22 and first side 30, as top portion 22 extends from central position 52 toward each housing end 46. For purposes of illustration, and as shown in FIGS. 1 and 4, slope of top portion 22 relative intersecting edge 74 at line 4-4, taken in proximity to central position 52, is approximately zero degrees (0°). However, it should be noted that slope at central position 52 have a value other than 0°. As further illustrated in FIGS. 1, 4, and 5, top portion 22 at line 5-5, situated intermediate line 4-4 and line 6-6 and relatively proximal housing end 46*b* compared to line 4-4, slants more steeply downwards relative intersecting edge 74, compared to top portion 22 at line 4-4. Accordingly, slope of top portion 22 relative intersecting edge 74 at line 5-5 is less than slope thereof at line 4-4. Finally, as illustrated in FIGS. 1, 5, and 6, line 6-6, which is situated relatively proximal housing end 46*b* compared to lines 4-4 and lines 5-5, slants still more steeply downwards relative intersecting edge 74 than at line 5-5. Thus, slope of top portion 22 relative intersecting edge 74 at line 6-6 is less than slope thereof at line 5-5.

Referring still to FIGS. 1, 4, 5, and 6, keys 24 are configured, e.g. positioned, shaped, and sized, on top portion 22 such that keys 24 and playing surfaces 36, as well as keyboard 20, extend thereon in generally parallel alignment with the shape of top portion 22, whether curved, straight, or slanted, as previously described. More specifically, keys 24 are configured on keyboard support section 76 of top portion 22, which extends generally under keys 24 and upon which keys 24 are mounted, such that playing surfaces 36 of keys 24, and therefore keyboard 20, extend along top portion 22 generally parallel other elements thereof, including hand plate 72 to define the general shape of top portion 22. Thus, keyboard 24, generally extends along curve, i.e. first curve 48, of top portion 22 when top portion 22 is curved. Further, and as shown in FIGS. 4, 5, and 6, when top portion 22 is slanted downwardly from first side 30 towards second side 32, as previously described, keys 24 are configured on top portion 22, namely on keyboard support section 74, such that keys 24 and playing surfaces 36 thereof are slanted downwardly from first key end 26 to second key ends 28 at slope of top portion 22.

Figure 7:
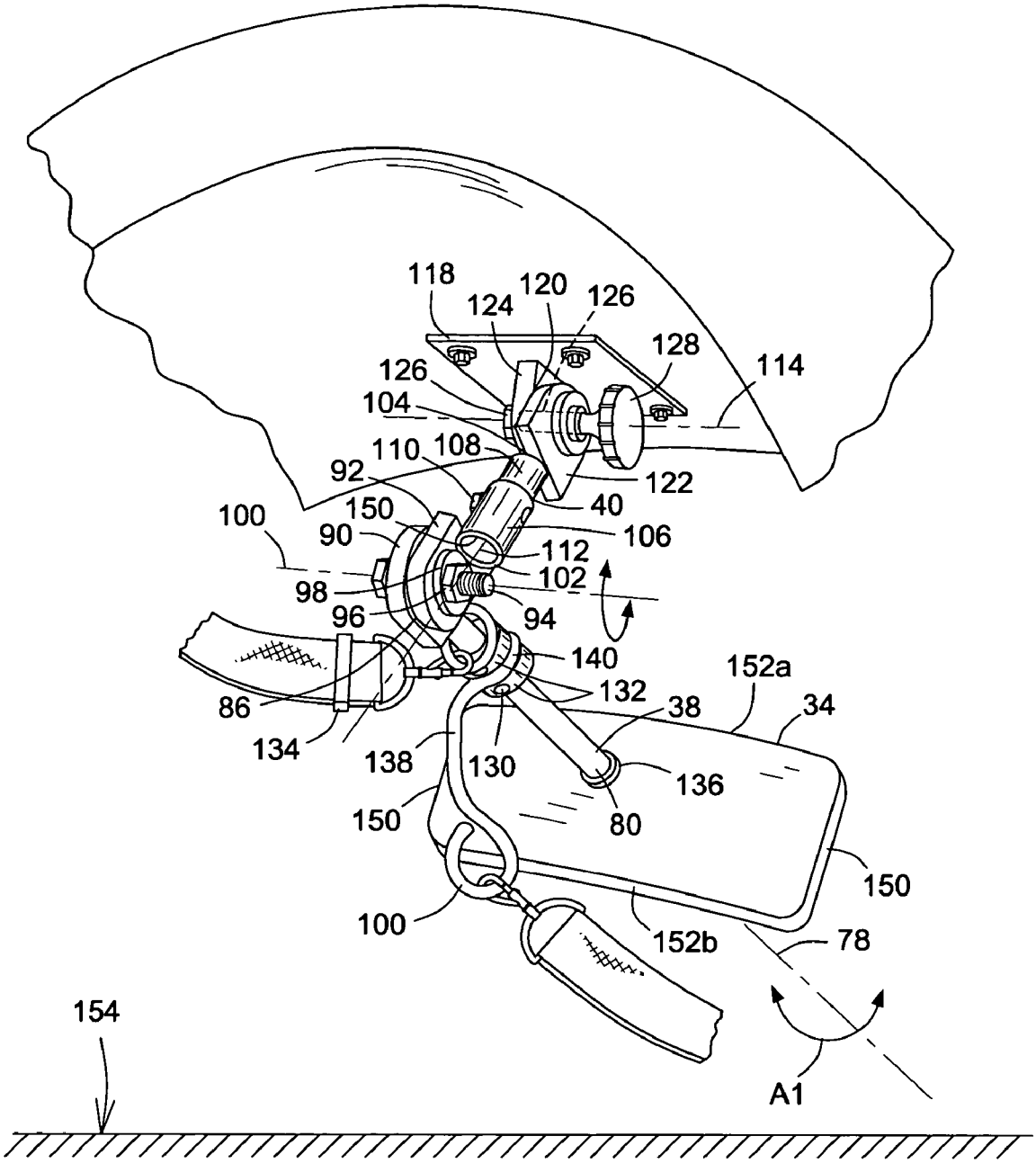
FIG. 7 is a partial side perspective view of the instrument shown in FIG. 1, illustrating the members connecting the housing of the instrument to the support plate thereof.

Reference is now made to FIGS. 1, 2 and 7. As best shown in FIG. 7, first member 38 is pivotally mounted on, and thus pivotally connected to, support plate 34 in first member housing 136 of support plate 34. Specifically, first member defines a first axis 78 around which first member 38, and housing 18 connected thereto by second member 40, is freely rotatable, as shown by arrows A1. Thus, as shown in FIGS. 1, 2 and 7, housing 18 may be rotated around first axis 78, when connected by first member 38 and second member 40 to support plate 34, away from and towards rest position 50.

It should be noted that second member 40, as shown in FIGS. 2 and 7, is connected to housing 18 at central position 52 thereon. Connection to housing 18 at central position 62 further facilitates, along with curved forms of top and bottom portions 22, 64 balancing housing 18 in rest position 50, including when housing 18 is suspended from shoulder 12 by strap 42 and supported on waist 14 by support plate 34. Further, mass of housing 18 is configured, i.e. distributed, such that mass thereof situated between first housing end 46*a* and central position 52 and second housing end 46*b* thereof and central position is essentially the same, thus further facilitating balance of housing 18 in rest position 50, as well as maintenance of housing 18 in rest position 50. In other words, housing 18 is configured such that, when in rest position 50, the centre of gravity thereof is axially aligned with central position 52 of housing, but situated below the pivot point of housing 18 relative first axis 78, namely the point or position thereon at which support plate 34 is connected to housing 18 by members 38, 40. Thus, whenever the housing 18 is rotated on first axis 78 away from rest position 50 by application of a force thereto, when force is removed, housing 18 will, eventually, rotate relative first axis 78 back towards rest position 50. For the embodiment shown, pivot point for housing 18 is, generally, the point at which second member 40 is connected by housing plate 118 to housing 18.

Rotation of housing 18 around first axis 78, which serves, among other things, to enable person 16 to provide expressive movement Thereof while playing instrument 50 and to still further improve visibility of keys 24 and hands 62 and key board 20 while person 16 is playing instrument 50, may be effected In a variety of ways. For example, person 16 could exert a force in a first direction with arm 58 or hand 62 on top portion 22, including key 24 or hand plate 72, or bottom portion 64 of housing 18 to cause rotation thereof. Further, housing 18 may be also be rotated on first axis 78 by movement of waist 14 or pelvis of person 16, not ably when housing 18 is supported on waist 14 with support plate 34 to exert force on housing 18.

Referring now to FIG. 7, it should be noted that first member 38 may be rotatably mounted in support plate 34 by any means which permits rotation of first member 38 around first axis 78 while securely retaining first member 38 in support plate 34. For example, first member 38 could have a flange, not shown, extending generally circularly therearound at a first member first end 80 thereof, with the flange freely mounted within first member housing 136 and the first member 38 extending outwardly therefrom through a support plate aperture, not shown, thereof sized and shaped to permit rotation of first member 38 while extending therethrough. In such case, flange would be sized and shaped such that flange may not pass through support plate aperture to ensure flange, and therefor first member 38 remains engaged in first member housing 136 of support plate 34. As another example, first member 38 could be mounted with a bearing, not shown, within first member housing 136 of support plate 34. Bearings, not shown, could also be employed with flange in first member housing 136 to facilitate movement of flange, i.e. rotation thereof around first axis 78, therein. It should be further noted that first member 40 could also be fixedly mounted to support plate 34 in an immobile configuration, if rotation of housing 18 around first axis 78 is not desirable. Finally, if desired, first member 38 may also be telescopic, i.e. telescopically extensible along axis 78. For example, first member 38 could, similar to second member 40, also have a hollow tube portion connected to support plate 34 and an extensible portion pivotally and telescopically mounted in the hollow portion to allow telescopic extension of first member 38 along first axis 78.

Referring now to FIGS. 1, 2, and 7, ideally, first member 38 is connected to support plate 34 at a pivot position, i.e. the position of in first member housing 136 for the embodiment shown, that is generally situated above the centre of gravity thereof, situated proximal a support plate portion thereof that preferentially is situated closer to ground surface 154 than the remainder of support plate 34. For example, for the embodiment shown, in which support plate 34 is rectangular in shape, first member 38 is connected Thereto in first member housing 136, i.e. the pivot point for support plate 34, at a position situated generally centrally between two opposing shorter sides 150 but generally closer to one longer side 152*a* of two generally opposed longer sides 152*a*, 152*b* than the centre of gravity of support plate 34. Accordingly, when support plate 34 is rotated, gravity will act on support plate 34 to draw support plate 34 back into a position in which longer side 152*b*, and the portion of support plate 34 situated proximately adjacent thereto, is situated proximal to the ground surface 154, compared to longer side 152*a*, and in which support plate longer side 152*b* extends substantially parallel to ground surface 154 and longitudinally across waist 14.

Referring again to FIG. 7, second member 40 is adjustably pivotally connected to housing 18 by second member connecting means which enables selective pivotal adjustment of second member 40, and thereby housing 18 connected thereto, relative first member 38, and thereby support plate 34 connected thereto, around a second axis 100 defined by second member connecting means. For the embodiment shown, first member connecting means is elbow joint 86, which has a first elbow joint plate 90, to which first member second end 84, generally longitudinally opposite first member first end 80, is connected, and a second elbow joint plate 92 connected to second member 40. Second elbow joint plate 92 is adjustably fastened to first elbow joint plate 90 by first releasable fastening means, shown as a elbow plate nut 96, elbow joint washer 98, and threaded elbow joint bolt 94 which extends through elbow joint plates 90, 92 and which is releasably retained extending therethrough by threaded elbow joint nut 96 and elbow joint washer 98. Specifically, in a respective retaining configuration for elbow joint 82, plates 90, 92 are fixedly and securely retained on bolt 94 in fixed, i.e. immobile, abutting contact with one another, with elbow joint washer also being held on bolt 94 in fixed abutting contact with one of plates 90, 92, by elbow joint nut 96, which is securely tightened on bolt 94 in abutting contact with elbow joint washer 98 to fixedly and securely hold washer 98 and plates 90, 92 immobilized relative one another in abutting contact to retain plates 90, 92, and therefore members 78, 80, in a fixed immobile position relative one another. To adjust position of second plate 92 relative first plate 90, and thereby position of second member 40 relative first member 38, elbow joint 86 is placed in a respective released configuration therefor, in which elbow joint nut 96 is unscrewed, generally away from washer 98 and plates 90, 92, thereby allowing second elbow joint plate 92 to be selectively rotated relative first elbow joint plate 90 on second axis 100 defined by elbow joint bolt 94 and, thereby, second member 40 to be selectively rotated, on second axis 100, relative first member 38. As housing 18 is connected to second member 40, housing 18 is also selectively pivotally rotatable, on second axis 100, relative first member 38, and thereby relative support plate 34 attached to first member 38, by selective pivotal rotation of second member 40 relative first member 38 on second axis 100. It should be noted that first member connecting means need not be limited to elbow joint 86 shown. Rather, first member connecting means 86 may include any means which adjustably pivotally connects members 38, 40 such that members 38, 40 are fixedly and securely held, i.e. immobilized, in a fixed, i.e. immobile, position relative one another when first member connecting means is in a respective retaining configuration therefore and which permits pivoting of second member 40 relative first member 38 about an axis 100 defined by first member connecting means, and preferably extending parallel to plate 34, when first member connecting means is in a respective released configuration therefor.

Referring yet again to FIG. 7, second member 80 is generally connected to first member connecting means, e.g. second elbow joint plate 92 for the embodiment shown, on a second member first end 102 thereof and to housing 18 on a generally opposed second member second end 104 thereof. As shown, second member 80 includes a generally hollow tube portion 106 extending from second member first end 102 and a extensible portion 108, extending from second member second end 104 into tube portion 106 and which is selectively telescopically mounted therein. Accordingly, second member 40 is telescopic. Extensible portion 108 of second member 40 is retained, i.e. immobilized, in a fixed position in tube portion 106 by releasable retaining means, shown as a threaded second member retaining screw 110 which extends into tube portion 106 through a tube portion aperture and abuttingly contacts extensible portion 108 to securely and fixedly hold extensible portion 108 in abutting contact with an inside wall 150 of tube portion 106. In other words, second member retaining screw 110 is tightened towards tube portion 106 to tightly hold extensible portion 108 immobilized against tube portion 106, i.e. an inside wall 150 thereof, to fixedly retain extensible portion 108 in a fixed, immobilized position relative tube portion 106. If second member retaining screw 110 is at least partially retracted, i.e. unscrewed, away from tube portion 106 such that second member retaining screw 110 no longer fixedly retains extensible portion 108 immobilized in abutting contact with tube portion 106, extensible portion 108 may be axially slid back and forth within tube portion 106 along third axis 112 defined thereby to telescopically extend and retract second member 40 along third axis 112, thereby permitting extension and retraction of housing 18, connected to second member 40, along third axis 112. It will be apparent to one skilled on the art that retaining means may, instead of second member retaining screw 110, consist of any means that can releasably retain extensible portion 108 in tube portion 106 in a fixed position, including for example, hooks, clamps, clasps, or the like that may be connected both to both portions 106, 108 to retain extensible portion 108 immobilized in a fixed, immobilized position relative tube portion 106.

Referring still to FIG. 7, second member 40 is adjustably pivotally connected to housing 18 by second member connecting means, which enables pivotal adjustment of housing 18 relative second member 40 around a fourth axis 114 defined by second member connecting means. In the embodiment shown, second member connecting means includes shoulder joint 120, connected to second member second end 104 and to housing plate 118, connected to housing 18, of second member connecting means. As shown, shoulder joint 120 has a first shoulder joint plate 122, to which second member second end 104 is connected, and a second shoulder joint plate 124 connected to housing plate 118. Second shoulder joint plate 124 is selectively and pivotally adjustably fastened to first shoulder joint plate 122 by second releasable fastening means, shown as threaded shoulder joint bolt 126, shown in dotted lines, which extends through shoulder joint plates 122, 124, and shoulder plate knob 128, which releasably retains shoulder plate bolt 126 extending through plates 122, 124. Shoulder plate knob 128 is adapted for screwing and unscrewing thereof on shoulder joint bolt 126 which extends thereinto, for example into a threaded socket, not shown, of knob 128, for, respectively, moving knob 128 on bolt 126 closer and further away from plates 122, 124. Specifically, in a respective retaining configuration for shoulder joint 120, plates 122, 124 are tightly and securely retained in fixed, i.e. immobile, abutting contact with one another, with knob 128 securely tightened on bolt 126 in abutting contact with one of plates 122, 124 to fixedly retain plates 122, 124 immobilized relative one another in abutting contact to retain plates 90, 92 and therefore second member 40 and housing 18 in a fixed position relative one another. To adjust position of second shoulder joint plate 124, connected to housing 18 by housing plate 118, relative first shoulder joint plate 122, and thereby position of housing 18 relative second member 40, shoulder joint 120 is placed in a respective released configuration, in which knob 128 is unscrewed, generally away from plates 122, 124 on shoulder joint bolt 126, thereby allowing second shoulder joint plate 124 to be selectively rotated relative first shoulder joint plate 122 on fourth axis 114 defined by shoulder joint bolt 126 and, thereby, housing 18 to be selectively pivoted, on axis 114, relative second member 40. It will be apparent to one skilled in the art that knob 128 could be replaced by a nut and washer combination for shoulder joint bolt 126, similar to nut 96 and washer 98 for elbow joint bolt 94, just as nut 96 and washer 98 for elbow joint bolt 94 could be replaced with a knob similar to that shown for shoulder joint 126. Further, as with first member connecting means, second member connecting means may include any means which adjustably pivotally connects members second member 40 to housing 18 such that such that second member 40 and housing 18 are retained immobilized relative one another in a fixed position when second member connecting means is in a respective retaining configuration therefore, and which permits pivoting of housing 18 relative second member 40, i.e. second member second end 104, about an axis defined by second member connecting means, and preferably extending parallel to plate 34 when second member connecting means is in a respective released configuration therefore.

It should be noted that, while preferable, second member 40 need not be connected to housing 18 at central position 52. Additionally, second member 40 may be connected, by second member connecting means, to housing 18 on top portion 22 thereof. Further, if rotation around second axis 100 is not desired, first member connecting means, e.g. second elbow joint plate 92, need not be rotatable relative second axis 100. Similarly, second member 40 need not be telescopically extensible if such capability is unnecessary or undesirable. In fact, if desired, second member 40 may be fixedly and rigidly connected, without adjustment or pivoting capability, to at least one of first member 38 and housing 18. If second member 40 is not deployed, first member 38 may directly be rigidly and fixedly connected to housing 18, without pivoting relative axes 78, 100, 112, 114, or with first member connecting means attached to housing plate 118, instead of second member 38, to provide pivoting of housing around axis 100, which would generally replace axis 114.

Referring now to FIGS. 2 and 7, length of strap 42 is adjustable to ensure that housing can be suspended from shoulder 12 with most, if not all of support plate 34 abutting waist 14. Accordingly, strap 42 has strap adjustment means, such as clips 134, buckles, notches, snaps, or the like to lengthen or shorten strap 42. Further, strap 42 is attached to first member 38 by strap connecting means, such as hooks 138, rings, clips or the like, through which first member 38 can, for example slidingly, pass and which permit rotation of first member 38 and strap connecting means 138 relative each other along first axis 78. Thus, housing 18 can be rotated on first axis 78 without requiring any movement of strap 42 along neck 44 and shoulders 12, which reduces friction, and therefore strain, exerted by strap 42 thereupon. Optional adjustable strap positioning means, shown as two strap sleeves 130 adjustably connected to first member 38 by strap sleeve screws 132, may be deployed to retain strap connecting means, shown as hook 138, within a fixed portion of first member 38 defined by strap positioning means. More specifically, for the embodiment shown, at least at least one hook 138 has a hook end 140 adapted, i.e. sized and shaped, to slide along first member 38, and thereby axially along first axis 78. Strap sleeves 130 are sized and shaped to prevent sliding of hook end 140, and thereby hook 135, therebeyond on first member 38. Thus, spacing apart of strap sleeves 138 defines a fixed portion of first member 38 extending therebetween to which sliding of hook end 140, when placed between strap sleeves 130, is limited. Thus, hook end 140, with hook 138 extending therefrom, is positioned within the fixed portion of first member 38 extending therebetween. Strap sleeves 130 are held in position on first member 38 by strap sleeve screws 132 which are adapted, i.e. sized and shaped, for tightening against, i.e. screwing towards, first member 38 to enter into abutting contact therewith to hold straps sleeves 130 in fixed position on first member 38. When strap sleeve screws 132 are loosened, i.e. unscrewed away from, first member 38, strap sleeves 130 can be axially slid on first member 38, i.e. along first axis 78, to adjust the position and size of fixed portion of first member 38 extending therebetween. p To facilitate use of instrument 10 with other electronic equipment, not shown, housing 18, optionally, has an antenna, not shown, disposed therein and connected to keyboard 20 for wirelessly receiving electronic musical inputs from other electronic devices, which then may be automatically rendered, i.e. played, by electronic keyboard 20. Such inputs may include any type of electronic musical signals or data, such as Musical Instrument Digital Interface (MIDI) data, MPEG-3 data, MPEG-4 data, uncompressed audio digital data or the like. Similarly, antenna may transmit electronic musical outputs of electronic musical signals generated by keyboard 20 to other electronic devices. Alternatively, if housing 18 is constructed of a material capable of acting as an antenna, such as a metal, housing 18 may itself serve as antenna. Housing 18 may also, optionally, have a rechargeable battery pack, not shown, to provide electrical power to instrument 10 and to allow cordless play thereof. Finally, housing 18 may have a motion sensor, not shown, disposed thereon for sensing motion thereof, such as rotation around first axis. Motion sensor is connected to a processor, not shown, connected to electronic keyboard 20 for interpreting motion of housing 10 and generating a corresponding electronic musical input for keyboard 20 which is then rendered thereby. The motion sensor may activated by manipulating one or more controls 200 shown in FIG. 1, used for controlling instrument or setting parameters therefore. Such controls 200, which may include buttons, knobs, switches, or the like, may be disposed anywhere on housing 18. However, preferably, controls 200 are preferably disposed in proximity to central position 52 on top portion 22 of housing 18, possibly on optional hand plate 72 if present. Location of controls 200 in proximity to central position 52 allows person 16 to easily manipulate controls 200 with either hand 62 while reducing any interruption of engagement of keys 24 with the hand 62.

Finally, it should be noted that housing 18 can be disconnected from second member 40 by detaching housing plate 118 from housing 18. Further, second shoulder joint plate 124 may also be disconnected from first shoulder joint plate 122. Similarly, second member 40 can also, if desired, be disconnected from first member 38. Accordingly, a different housing, keyboard, or musical instrument may be connected to second member 40 or first member 38 for pivotal connection, relative first axis, to support plate 34. Thus, support plate 34 and members 38, 40 may also serve, along with strap, as a support for another musical instrument carriable on waist 14 and suspended from shoulder 12 by strap 42. Further, support plate 34 may be connected to an instrument stand, or a surface, other than waist 14 of person 16, for use in conjunction with members 38, 40 as a support for the housing 18 or another instrument connected by members 38, 40 to support plate 34. When support plate 34 and members 38, 40 are used as a support for housing 18 or another instrument which not carried by person 16, strap 42 is optional.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A portable electronic musical keyboard instrument comprising:

a housing having an electronic musical keyboard housed therein and extending along a top portion thereof and situated generally opposite a bottom portion thereof, said electronic musical keyboard having a plurality of keys extending adjacent one another between longitudinally opposed first and second housing ends of said housing, said keys having respective generally opposed first key ends and second key ends situated respectively proximal first and second sides of said housing extending between said first and second housing ends and defining said top and bottom portions therewith, said first side being situated proximal a person when playing said instrument, said top portion and said electronic musical keyboard being curved generally vertically away from said first and second housing ends towards a first apex situated at a central position of said housing situated generally centrally between said first and second housing ends;

a support plate;

at least one elongate member connecting said support plate to said housing; and a strap connected to said member and to said housing, said strap and said support plate being respectively adapted for suspending said housing from at least one shoulder of said person and abuttingly contacting a waist of said person for supporting said housing on said waist.

2. The instrument of claim 1, wherein said electronic musical keyboard is disposed generally centrally between said first and second housing ends.

3. The instrument of claim 1, wherein said housing is positionable in a rest position in which said top portion extends upwardly away from said first and second housing ends towards said central position.

4. The instrument of claim 3, wherein said first and second sides flare outwardly away from said central position toward each said housing end.

5. The instrument of claim 3, wherein said top portion is slanted, when said instrument is in said rest position, from said first side downwardly towards said second side at decreasing slope from said central position to each said housing end.

6. The instrument of claim 5, wherein said slope at said central position is approximately zero degrees (0°).

7. The instrument of claim 3 wherein said housing is connected to said support plate by said at least one elongate member at said central position.

8. The instrument of claim 3, wherein said top portion is tapered inwardly toward said central position in proximity to each said housing end.

9. The instrument of claim 3, wherein each said housing end is tapered, from said second side to said first side, towards said central position.

10. The instrument of claim 1, wherein said keys have respective playing surfaces for engagement by fingers of said person while playing said instrument, said keys being configured on said top portion with said playing surfaces extending in parallel alignment with said top portion.

11. The instrument of claim 1, wherein said bottom portion is curved to define a bottom portion curve extending between said first and second housing ends.

12. The instrument of claim 1, wherein said bottom portion extends generally parallel to said top portion between said first and second housing ends.

13. The instrument of claim 1, wherein said top portion has a hand plate extending from said keyboard, at said first key ends, to said first side, said hand plate being sized and shaped for contacting engagement by at least one of a hand and a wrist of said person while playing said instrument.

14. The instrument of claim 1, wherein said strap has strap adjustment means for adjusting length of said strap.

15. The instrument of claim 1, wherein said at least one elongate member comprises a first member pivotally mounted on said support plate and defining a first axis around which said housing is rotatable.

16. The instrument of claim 15, wherein at least one of said first member and said strap has a strap connecting means for connecting said strap to said first member, said strap connecting means and said first member being rotatable relative one another around said first axis.

17. The instrument of claim 16, further comprising a strap positioning means for retaining said strap connecting means on a fixed portion of said first member defined by said strap positioning means.

18. The instrument of claim 15, further comprising a first member connecting means and wherein said at least one elongate member further comprises a second member connecting said housing and said first member to one another, said second member being pivotally adjustably connected to said first member by said first member connecting means which defines a second axis around which said second member, and thereby said housing, can be selectively rotated relative said first member.

19. The instrument of claim 18, further comprising a second member connecting means pivotally adjustably connecting said second member to said housing, said second member connecting means defining a fourth axis around which said housing can be selectively rotated relative said second member.

20. The instrument of claim 15, wherein said at least one elongate member further comprises a second member connecting said housing and said first member, said second member being selectively telescopically extensible along a third axis defined by said second member.

21. The instrument of claim 1 wherein said at least one elongate member is connected to said housing on said bottom portion.

* * * * *